US005637842A

United States Patent [19]

Yonemoto et al.

[11] Patent Number: 5,637,842

[45] Date of Patent: Jun. 10, 1997

[54] ELEVATOR SAFETY DEVICE

[75] Inventors: Masashi Yonemoto; Hiroyasu Itoh, both of Inazawa, Japan

[73] Assignee: Mitsubishi Denki Kabushiki Kaisha, Tokyo, Japan

[21] Appl. No.: 350,160

[22] Filed: Nov. 30, 1994

[30] Foreign Application Priority Data

Dec. 1, 1993 [JP] Japan ..... 5-301839

[51] Int. Cl.[6] ..... B66B 5/00; B66B 1/36

[52] U.S. Cl. ..... 187/294; 187/282; 187/394

[58] Field of Search ..... 187/294, 282, 187/394, 359

[56] References Cited

U.S. PATENT DOCUMENTS

| | | | |
|---|---|---|---|
| 3,333,657 | 8/1967 | Inuzuka et al. | 187/35 |
| 4,067,416 | 1/1978 | Lowry | 187/29 R |
| 4,127,843 | 11/1978 | Anzai et al. | 340/21 |

FOREIGN PATENT DOCUMENTS

| | | | |
|---|---|---|---|
| 3-133889 | 6/1991 | Japan | 187/394 |
| 5-254755 | 10/1993 | Japan | 187/394 |
| 6-183662 | 7/1994 | Japan | 187/394 |

OTHER PUBLICATIONS

"Safety Code for Elevators and Escalators", ASME Jan. 1990, pp. 79 and 80.

*Primary Examiner*—Robert Nappi
*Attorney, Agent, or Firm*—Leydi, Voit & Mayer

[57] ABSTRACT

An elevator safety device in which a counterweight cam is attached to the counterweight and top terminal landing final limit switches are disposed below the bottom terminal landing of the hoistway so that it is operated by the counterweight cam. The top terminal landing final limit switches only need to be provided in accordance with the counterweight buffer stroke, regardless of to what extent the car has been flung upward, with the result that fewer final limit switches are required.

6 Claims, 5 Drawing Sheets

ELEVATOR SAFETY DEVICE

BACKGROUND OF THE INVENTION

1. Field of the Invention

The present invention relates to an elevator safety device for causing a car to make an emergency stop when it has traveled above the top terminal landing or below the bottom terminal landing in the hoistway.

2. Description of the Related Art

In general, elevators are required to have a final limit switch which is a safety device. The final limit switch functions in accordance with Rule 209.3 Final Terminal Stopping Device in ASME A17.1-1990 described below.

That is, the device shall be so designed and installed that it will continue to function:

(1) at the top terminal landing, until the car has traveled above this landing a distance equal to the counterweight runby plus 1.5 times the buffer stroke, but in no case less than 2 it (610 mm);

(2) at the bottom terminal landing, until the car rests on its fully compressed buffer.

FIG. 4 illustrates the construction of one example of a conventional elevator safety device. In the figure, a hoisting machine sheave 1 is provided in the upper portion of a hoistway, and a deflector sheave 2 is provided near this hoisting machine sheave 1. A rope 3 is wound around the sheave 1 and the deflector sheave 2. A car 4 hangs down from one end of the rope 3, while a counterweight 5 hangs down from the other end.

A car buffer 6A and a counterweight buffer 6B are each provided in the lowest portion of the hoistway. A car cam 9 serving as a car contactor is attached to the side surface of the car 4. Above the top terminal landing 7 of the hoistway, a plurality of top terminal landing final limit switches 10A (10A1 through 10An) are spaced apart and disposed along the hoisting direction. Below the bottom terminal landing of the hoistway, a plurality of bottom terminal landing final limit switches 11A (11A1 through 11An) are spaced apart and disposed along the hoisting direction. The top terminal landing and bottom terminal landing final limit switches 10A and 11A are engaged with the cam 9 for operation.

FIG. 5 is a control circuit diagram for the safety device of FIG. 4. Normally-closed contacts 10B1 through 10Bn of the top terminal landing final limit switches 10A1 through 10An and normally-closed contacts 11B1 through 11Bn of the bottom terminal landing final limit switches 11A through 11An are connected in series with one another between a positive main line P and a negative main line N of the direct-current power supply. Other safety devices 11 and a safety relay 12 are connected in series with the normally-closed contacts 10B1 through 10Bn and 11B1 through 11Bn.

Next, the operation will be described. When the elevator moves up, and for some reason cannot be stopped and travels above the top terminal landing 7, the car cam 9 engages with the top terminal landing final limit switch 10A1 to open the normally-closed contact 10B1. This deenergizes the safety relay 12, which stops power from being supplied to the hoisting machine and generates a braking command so that the car 4 makes an emergency stop. On the other hand, when the car 4 travels below the bottom terminal landing 8, the car cam 9 engages with the bottom terminal landing final limit switch 11A1 to open the normally-closed contact 11B1, thereby causing the car 4 to make an emergency stop in the same way.

When the operating speed of the elevator is low, the car buffer 6A stroke and the counterweight buffer 6B stroke, in general, are small. This means that even when the buffers 6A and 6B are full compressed after the car 4 or counterweight 5 has traveled above the top or below the bottom terminal landing and has stopped, the car cam 9 continues to be engaged with the top terminal landing final limit switch 10A1 or the bottom terminal landing final limit switch 11A1. Accordingly, in this case, only one final limit switch needs to be provided for the top terminal landing, and the bottom terminal landing respectively.

As the operating speed of the elevator increases, the stroke of each of the buffers 6A and 6B is increased in proportion to the square of the elevator speed. Therefore, when the buffers 6A and 6B are fully compressed, the car cam 9 passes the top terminal landing final limit switch 10A1 or the bottom terminal landing final limit switch 11A1, thereby causing either of the switches to be disengaged from the cam. To overcome this problem, a plurality of top and bottom terminal landing final limit switches 10A and 11A are respectively arranged, so that when the car 4 has traveled above the top terminal landing 7 or below the bottom terminal landing 8, the car cam 9 is continuously engaged with either of the switches to keep the safety relay 12 in a deenergized state.

When the car 4 has passed the top terminal landing 7 at a high speed, the counterweight 5 collides against the counterweight buffer 6B and stops. However, this is dangerous because the car 4 may be flung upward due to energy of motion. An action is taken to overcome this problem as described below. As mentioned above in Rule 209.3 in the ASME A17.1-1990, it is stated that the top terminal landing final limit switch should allow the safety device to continue to function at the top terminal landing, until the car has traveled above this landing a distance equal to the counterweight runby plus 1.5 times the buffer stroke, but in no case less than 2 ft (610 mm). Based on this, a plurality of top terminal landing final limit switches 10A are arranged so that they are not disengaged from the car cam 9 even when the car 4 has been flung upward.

In the conventional elevator safety device having the above-described construction, it is necessary to install a large number of top terminal landing final limit switches 10A1 through 10An to overcome the problem that the car 4 is flung upward. This results in increased costs.

SUMMARY OF THE INVENTION

The object of the present invention is to overcome the above-described problem by providing a low-cost elevator safety device, which uses fewer top terminal landing final limit switches.

To this end, according to one aspect of the present invention, there is provided an elevator safety device comprising a car contactor attached to the car, a plurality of bottom terminal landing switches which are arranged along the hoisting direction below the bottom terminal landing of the hoistway and operated by means of the car contactor to allow generation of an emergency stop command, a counterweight contactor attached to the counterweight, and a plurality of top terminal landing final limit switches which are arranged in the ascending direction below the bottom landing terminal of the hoistway and operated by means of the counterweight contactor to allow generation of an emergency stop command.

According to another aspect of the present invention there is provided an elevator safety device comprising a car contactor attached to the car, a plurality of bottom terminal landing final limit switches which are arranged in the hoisting direction below the bottom terminal landing of the hoistway and operated by means of the car contactor to allow generation of an emergency stop command, a counterweight contactor attached to the counterweight, a top terminal landing car side final limit switch which is disposed above the top terminal landing of the hoistway and operated by means of the car contactor to allow operation of an emergency stop command, and a top terminal landing counterweight side final limit switch which is disposed below the bottom terminal landing of the hoistway and operated by means of the counterweight contactor to allow generation of an emergency stop command.

DESCRIPTION OF THE PREFERRED EMBODIMENTS

The embodiments of the present invention will hereunder be described with reference to the drawings.

First Embodiment

Figure 1:
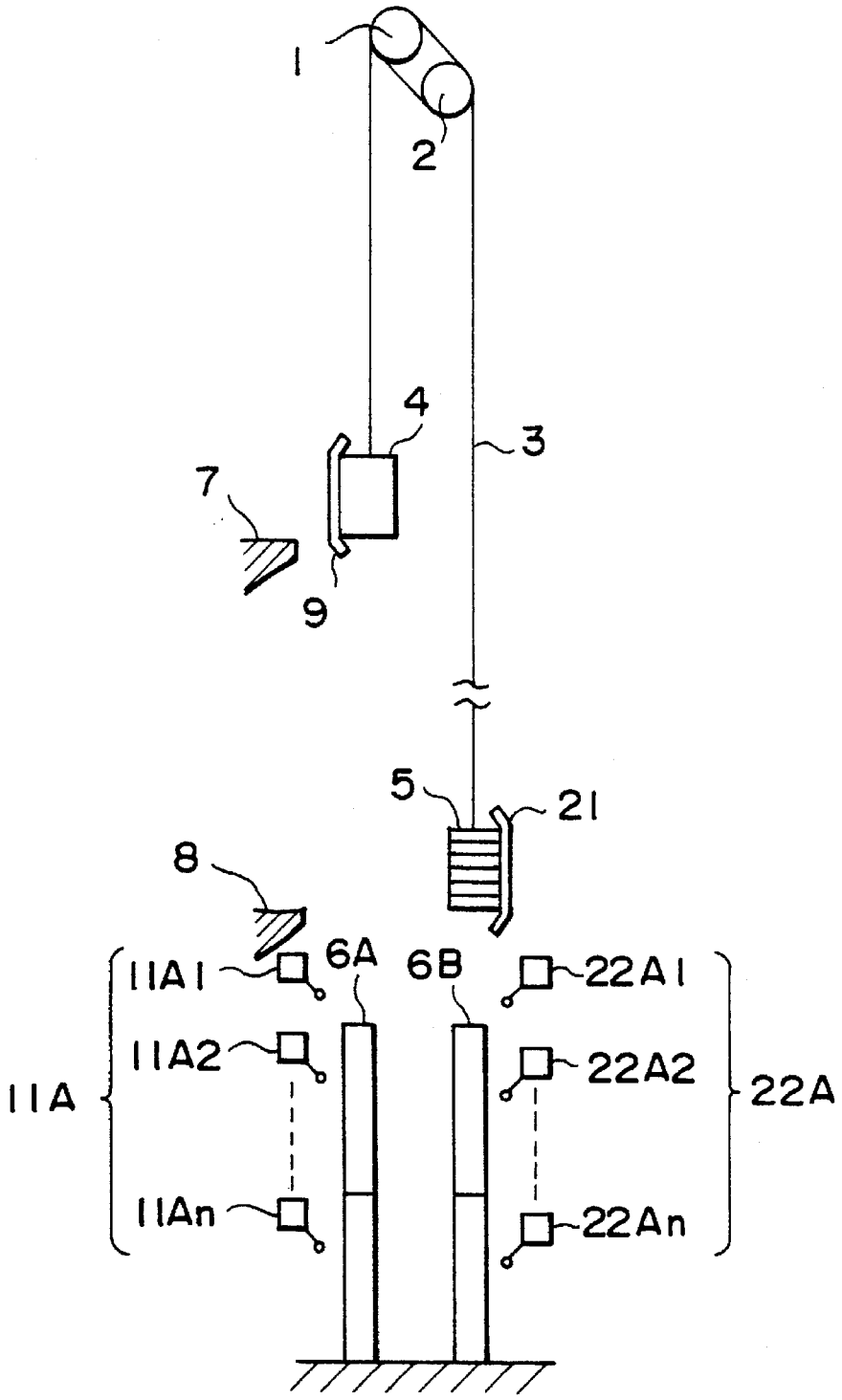
FIG. 1 illustrates a construction of an elevator safety device as one embodiment of the present invention.
Figure 4:
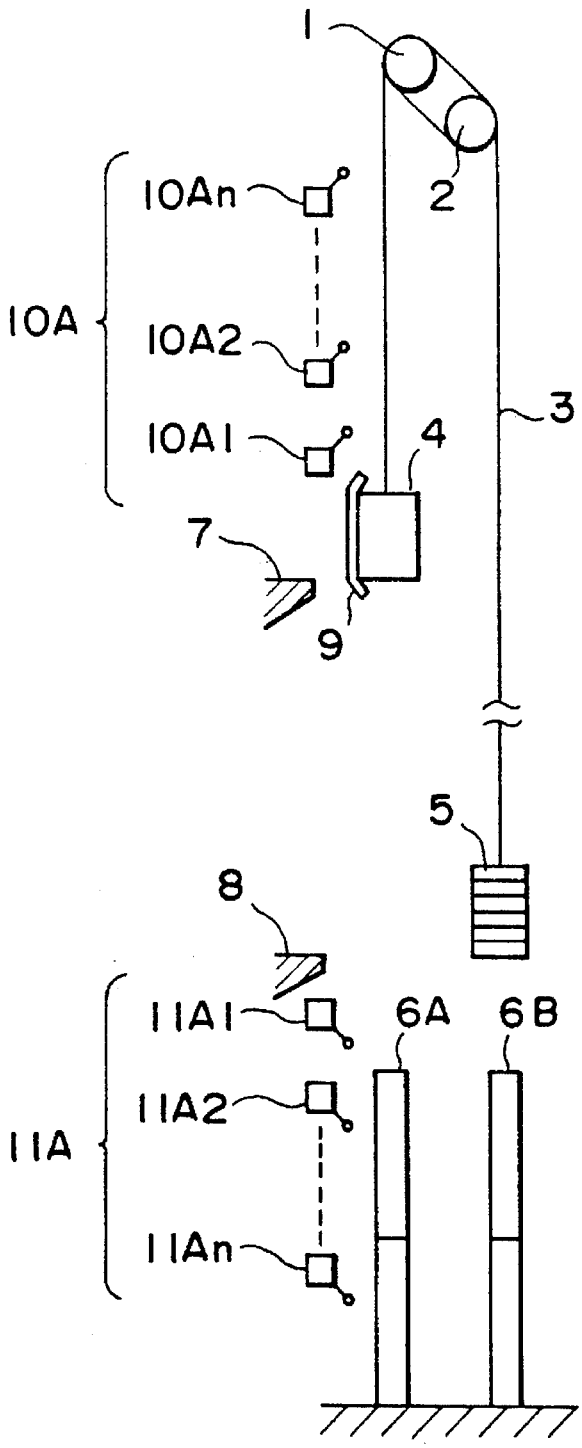
FIG. 4 PRIOR ART
FIG. 4 illustrates one example of a conventional elevator safety device.
Figure 5:
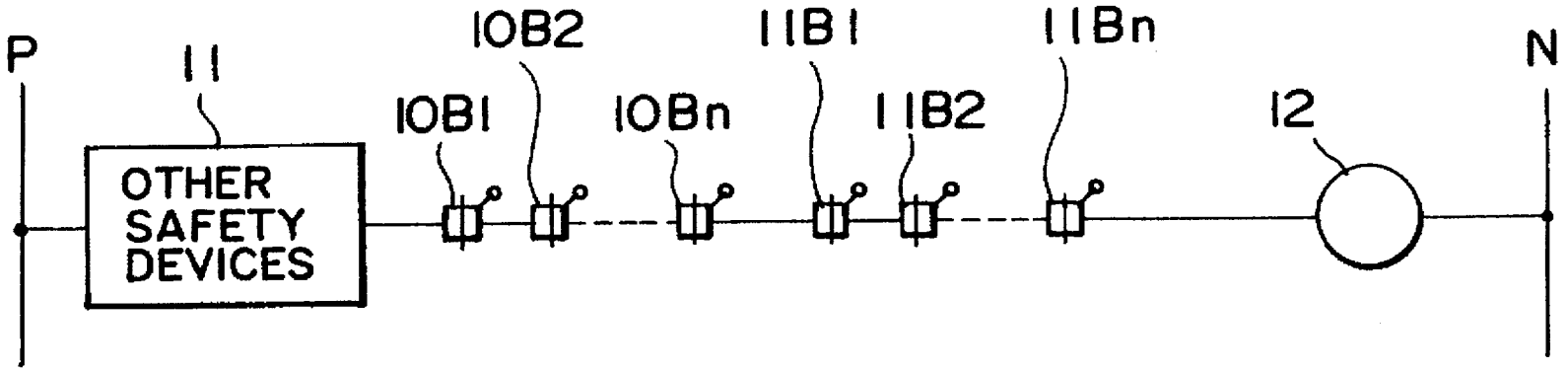
FIG. 5 PRIOR ART
FIG. 5 illustrates a control circuit for the device of FIG. 4.

FIG. 1 illustrates a construction of an elevator safety device as one embodiment of the present invention. In FIGS. 4 and 5, the same or corresponding portions as to those in FIG. 1 are given the same reference numerals, so that they will not be described below.

In the figure, a counterweight cam 21, which serves as a counterweight contactor, is attached to the side surface of a counterweight 5. A plurality of top terminal landing final limit switches 22A (22A1 through 22An) are spaced apart from one another along the hoisting direction and disposed below the bottom terminal landing 8 of the hoistway at the counterweight 5 side. Each of these top terminal landing final limit switches 22A are operated by being engaged with the counterweight cam 21. Each of the top terminal landing final limit switches 22A has a normally-closed contact (not shown). These normally-closed contacts are connected in series with the safety relay 12 in the same manner as the normally-closed contacts 11B1 through 11Bn shown in FIG. 5.

In the above-described safety device, as in the conventional device, bottom terminal landing final limit switches 11A are operated by means of the car cam 9, which deenergizes the safety relay 12. When the car goes up above the top terminal landing 7, the top terminal landing final limit switches 22A engage with the counterweight cam 21 and are operated to deenergize the safety relay 12. This stops power from being supplied to the hoisting machine and generates a braking command, thereby causing the car 4 to make an emergency stop.

At this time, even when the car 4 is flung upward by kinetic energy created by the car which has passed the top terminal landing 7 at a high speed, the counterweight 5 consistently stops within the counterweight buffer 6B stroke. Therefore, the counterweight cam 21 continues to be engaged with any one of the top terminal landing final limit switches 22A1 through 22An. For this reason, irrespective of how much the car 4 has been flung upward, the top terminal landing final limit switches 22A are provided in accordance with the counterweight buffer 6B stroke, so that fewer switches are needed compared to conventional devices, thereby reducing costs.

The number of the top terminal landing final limit switches and the bottom terminal landing final limit switches, which need not be the same, only need to be determined based on the elevator speed and the buffer stroke.

In the first embodiment, although the cams 9 and 21 were used respectively as the car and counterweight contactors, the contactors are not limited thereto. They may take a different form and have a different construction as long as they serve as contacts for each of the switches for operation by the movement of the car 4 and the counterweight 5.

Second Embodiment

Figure 2:
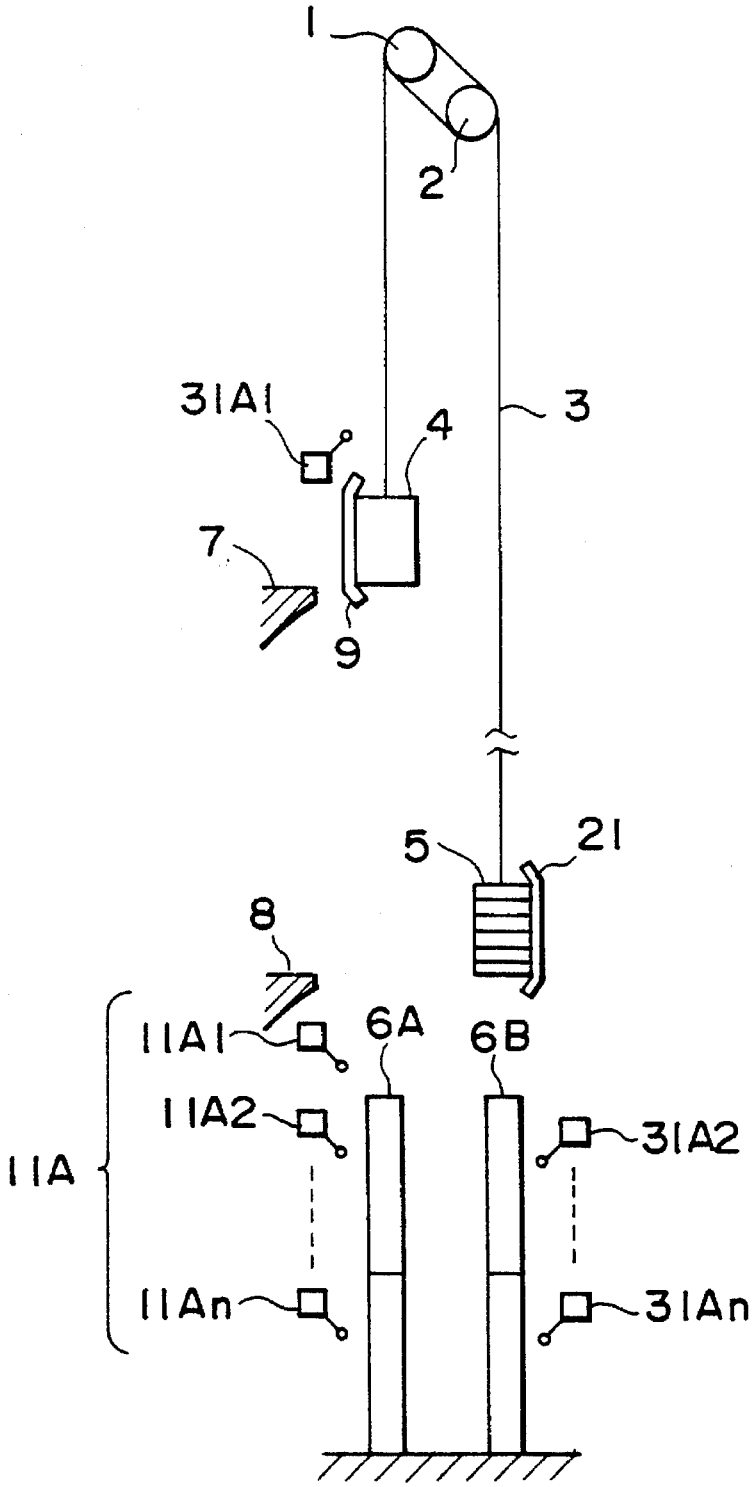
FIG. 2 illustrates a construction of an elevator safety device as another embodiment of the present invention.

FIG. 2 illustrates a construction of an elevator safety device as another embodiment of the present invention. In the same figure, a top terminal landing car side final limit switch 31A1 is disposed above the top terminal landing 7 of the hoistway at the car 4 side. The top terminal landing car side final limit switch 31A1 is operated by means of a car cam 9. A plurality of top terminal landing counterweight side final limit switches 31A2 through 31An are spaced apart from one another along the hoisting direction and disposed below the bottom terminal landing 8 of the hoistway at the counterweight 5 side. The top terminal landing counterweight side final limit switches 31A2 through 31An are each operated by means of the counterweight cam 21.

In the safety device having the above-described construction, when the car 4 moves upward and travels above the top terminal landing 7, first, the top terminal landing car side final limit switch 31A1 is operated by means of the car cam 9, which deenergizes the safety relay 12 (FIG. 5). Thereafter, as the car 4 moves further upward, the top terminal landing counterweight side final limit switches 31A2 through 31An are successively operated for continued deenergization of the safety relay 12.

In the above-described safety device, except for the first final limit switch 31A1, the top terminal landing final limit switches are disposed along the counterweight side, so that as in the first embodiment, fewer top terminal landing final limit switches 31A1 through 31An need to be used for the safety device as compared to conventional devices.

As is well known, a temperature change or passage of time may cause rope 3 to expand or contract. Therefore, when the top terminal landing final limit switches are all arranged along the counterweight side, the operating point as seen from the car 4 may become unstable. That is, the top terminal landing final limit switches operate when the car 4 has traveled above the top terminal landing more than a predetermined distance. Therefore, when all of these switches are arranged at the counterweight side, an expansion or contraction of the rope causes a change in the distance between the car 4 and the counterweight 5, thereby changing the operating point. This tendency is stronger, particularly, for high rise elevators which use long ropes.

In the second embodiment, the first top terminal landing final switch 31A1 is arranged at the car side. Therefore, the operating distance between the first and the second top terminal landing final limit switches 31A1 and 31A2 is fixed to allow for rope 3 expansion and contraction. This makes the operating point to be stable, which ensures optimum reliability and safety.

In the aforementioned second embodiment, one top terminal landing final limit switch is provided at the car side in the hoistway, and the other switches are arranged at the counterweight side. However, two or more switches may be arranged at the car side, and only one switch disposed at the counterweight side for operation when the counterweight buffer 6B is fully compressed.

Third Embodiment

Figure 3:
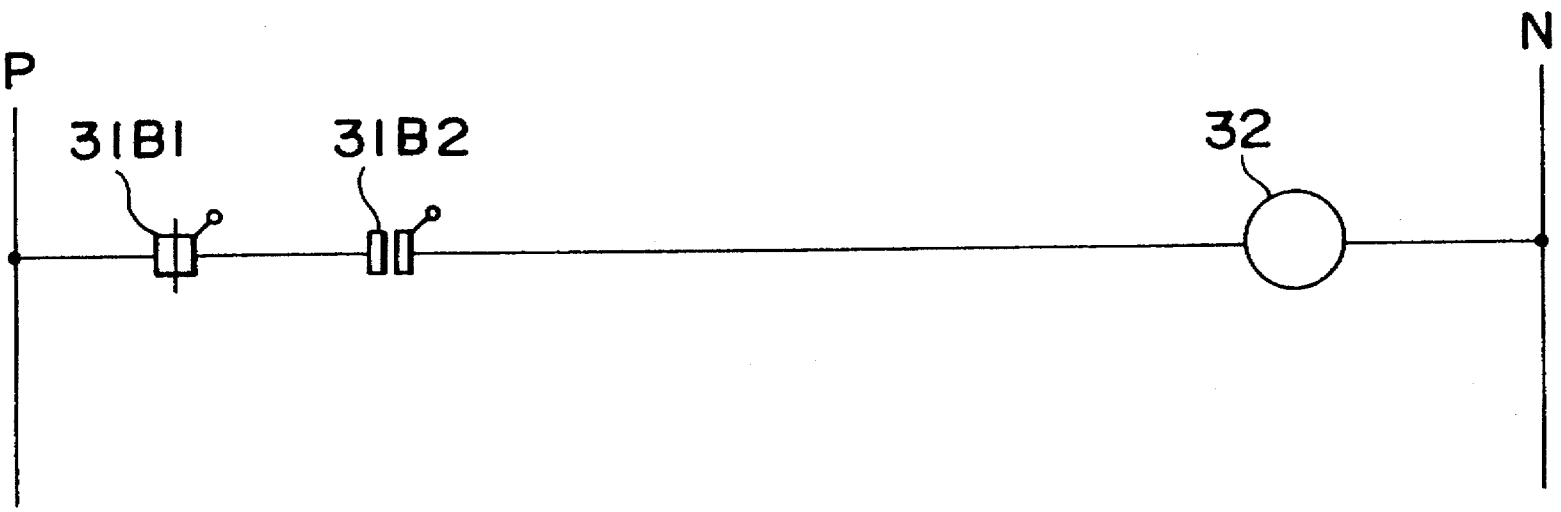
FIG. 3 illustrates a control circuit for an elevator safety device as still another embodiment of the present invention.

FIG. 3 illustrates a circuit for controlling an elevator safety device as a further embodiment of the present invention. A normally-closed contact 31B1 and a normally-open contact 31B2 are provided for the top terminal landing car side final limit switch 31A1 and top terminal landing counterweight side final limit switch 31A2 separately from the safety relay 12 normally-closed contacts. The contacts 31B1 and 31B2 are connected in series with a rope expansion detection relay 32. A rope expansion detecting means of the third embodiment includes the normally-closed contact 31B1, the normally-open contact 31B2, and the rope expansion detection relay 32.

In the aforementioned safety device, when the car 4 has been manually flung upward from the top terminal landing 7 during maintenance test for inspecting general equipment, it is common to first operate the top terminal landing car side final limit switch 31A1 by means of the car cam 9. At this time, counterweight 5 is located below the top terminal landing 8 and above the top terminal landing counterweight side final limit switch 31A2. For this reason, when the car 4 moves further upward, the counterweight 5 moves downward, which allows the top terminal landing side final limit 31A2 to be operated by means of the counterweight cam 21. Here, the normally-open contact 31B2 closes after the normally-closed contact 31B1 has opened, so that the rope expansion detection relay 32 will not operate.

An expansion of rope 3 causes the counterweight 5 to be lowered by the amount equivalent to the expansion when the top terminal landing car side final limit switch 31A1 has been operated. Therefore, when the rope 3 expands by an amount greater than an amount determined by the positions of the final limit switches 31A1 and 31A2, the top terminal landing counterweight side final limit switch 31A2 is operated before the top terminal landing car side final limit switch 31A1.

In this case, since the normally-open contact 31B2 closes before the normally-closed contact 31B1 opens, the rope expansion detection relay 32 operates to warn the maintenance person that rope expansion has occurred by means of a warning means such as a buzzer. Accordingly, abnormal expansion of the rope 3 can be detected beforehand for use in preventive maintenance, which results in enhanced safety and more efficient maintenance and inspection.

What is claimed is:

1. An elevator safety device comprising:

a car contactor attached to a car;

a plurality of bottom terminal landing final limit switches which are arranged along the hoisting direction below a bottom terminal landing of a hoistway and actuated to generate bottom position signals upon engagement with said car contactor;

a counterweight contactor attached to a counterweight;

a plurality of top terminal landing final limit switches which are arranged in the hoisting direction below the bottom landing terminal of the hoistway and actuated to generate top position signals upon engagement with said counterweight contactor; and means for generating an emergency stop command, said means being responsive to the top and bottom position signals.

2. An elevator safety device according to claim 1, wherein said car contactor and said counterweight contactor include a cam.

3. An elevator safety device comprising:

a car contactor attached to a car;

a plurality of bottom terminal landing final limit switches which are arranged in the hoisting direction below a bottom terminal landing of a hoistway and actuated to generate bottom position signals upon engagement with said car contactor;

a counterweight contactor attached to a counterweight;

a top terminal landing car side final limit switch which is disposed above a top terminal landing of the hoistway and actuated to generate a first top position signal upon engagement with said car contactor;

a top terminal landing counterweight side final limit switch which is disposed below the bottom terminal landing of the hoistway and actuated to generate a second top position signal upon engagement with said counterweight contactor; and means for generating an emergency stop command responsive to the bottom position signals and the first and second top position signals.

4. An elevator safety device according to claim 3 further comprising a rope expansion detecting means for detecting an abnormal expansion of a rope which suspends the car and the counterweight, from the operation timing of said top terminal landing car side final limit switch and said top terminal landing counterweight side final limit switch.

5. An elevator safety device according to claim 4, wherein said top terminal landing car side final limit switch and said top terminal landing counterweight side final limit switch are disposed such that with a rope length being in a normal range, said top terminal car side final limit switch is the first to be operated when the car has passed the top terminal landing.

6. An elevator safety device according to claim 3, wherein a cam is used for each of said car contactor and said counterweight contactor.

* * * * *